United States Patent [19]

Wilcox et al.

[11] Patent Number: 4,553,455

[45] Date of Patent: Nov. 19, 1985

[54] NUT STARTER WITH SPECIAL BLADES

[76] Inventors: Melvin S. Wilcox, 347 Rosemore Dr., Davison, Mich. 48423; Vernon L. Schwerin, 1148 Nottingham Dr., Lapeer, Mich. 48446

[21] Appl. No.: 565,551

[22] Filed: Dec. 27, 1983

[51] Int. Cl.[4] ..... B25B 23/08

[52] U.S. Cl. ..... 81/443; 81/111

[58] Field of Search ..... 81/111, 112, 113, 114, 81/13, 442, 443, 444, 445, 446, 447, 448, 449, 450

[56] References Cited

U.S. PATENT DOCUMENTS

| | | | |
|---|---|---|---|
| 2,740,311 | 4/1956 | Tedei | 81/447 |
| 2,787,492 | 4/1957 | Gisser et al. | 81/445 |
| 3,208,489 | 9/1965 | Walker et al. | 81/443 |
| 3,288,184 | 11/1966 | Kyser | 81/443 |

*Primary Examiner*—James L. Jones, Jr.

*Attorney, Agent, or Firm*—Caesar, Rivise, Bernstein & Cohen, Ltd.

[57] ABSTRACT

A starter for a nut, the starter having blades with outer edges possessing at least one innermost flat, at least one outer flat and a step connecting said flats.

6 Claims, 9 Drawing Figures

NUT STARTER WITH SPECIAL BLADES

BACKGROUND OF THE INVENTION

This invention relates to a nut starter with special features. In particular the present invention is specifically intended for the handling and starting of nuts or other threaded sleeves or members onto screw-type fasteners and other threaded members.

In many operations involving handling and starting of nuts, it has been found extremely difficult, if not impossible, to hold the nut in place in a particular relationship with a screw or threaded member, while at the same time imparting a rotary motion to the nut so that it can be threaded onto the threaded member. One reason for this difficulty is lack of access space for the hands and fingers or at times, the small size of the nut. Similar problems have been encountered in connection with starting of screws where various devices have been developed which will temporarily secure the screw on the head of a screwdriver. To solve these problems, screw starters, such as are shown in U.S. Pat. No. 3,288,184 and others as in recently filed U.S. Application Ser. No. 519.789, filed Aug. 3, 1983, now abandoned, Applicant Robert K. Simcox entitled Screw Starter For Screws Having Cross-Cut, Recessed Head Socket And Other Openings, have been developed.

While nut starting devices have been heretofore proposed, most of such prior nut starters suffer from the disadvantage that the nut is not visible to the eye and thus additional problems are introduced. There is a nut starter as show in U.S. Pat. No. 3,853,025 where the nut is visible to the eye. Such nut starter possesses an axial extension with a rounded leading end and wherein the axial extension has a length of about one and one half times the mean diameter of the axial extension for insertion into the central opening of a nut. In such a device the axial extension frictionally engages a portion of the internal threading of the nut. While the nut starter of U.S. Pat. No. 3,853,025 has been of value, it has suffered from several disadvantages including the fact of being limited for use with a very narrow range of nut openings. Also, the axial extension of such nut starter makes sliding contact with certain internal threads of the nut and hence has somewhat of an abrasive action upon such internal threads.

OBJECTS OF THE INVENTION

From the foregoing it will be seen that an object of the present invention is to provide an improved nut starter possessing special blades which is used to start a nut in such a way that the nut is always visible to the eye of the user. This greatly aids maneuverability and shortens the time necessary to complete the nut threading action.

It is another object of the present invention to provide a nut starter with special blades for temporarily securing a nut thereon.

It is a further object of the present invention to provide a nut starter with special blades, that is simple in construction and durable in use.

Another object of the present invention is to provide a nut starter with special blades which can be used with an extensive range of nut sizes and nut opening sizes.

SUMMARY OF THE INVENTION

The foregoing as well as other objects of the invention are accomplished by providing a nut starter with special blades, having a shank portion and a bit portion formed at one end thereof. The bit portion comprises two divering angular wing portions, with the forward ends of the wings terminating in slightly inclined (positive or negative) nut opening gaging tips or fingers adapted to be releasably secured in the opening in a nut. The outer edges of the wing portions are formed into at least two steps defining edges, one of which releasably grips a portion of the internal threaded opening of a nut. In a preferred embodiment of the invention a sleeve is slidably mounted over the shank portion and the bit portion of the tool to be constructed in the manner of U.S. Pat. No. 3,288,184. Accordingly, sliding of the sleeve forwardly or toward the work end will cause the wing portions to converge to permit entry into the threaded opening of a nut or release of the nut upon completion of the operation.

DESCRIPTION OF THE INVENTION

Other objects and many of the attendant advantages of this invention will be readily appreciated as the same becomes better understood by reference to the following detailed description when considered in connection with the accompanying drawings wherein.

DETAILED DESCRIPTION OF THE PREFERRED EMBODIMENT

Figures 1, 2, 3, 4, 5, 6, 7, 8, 9:
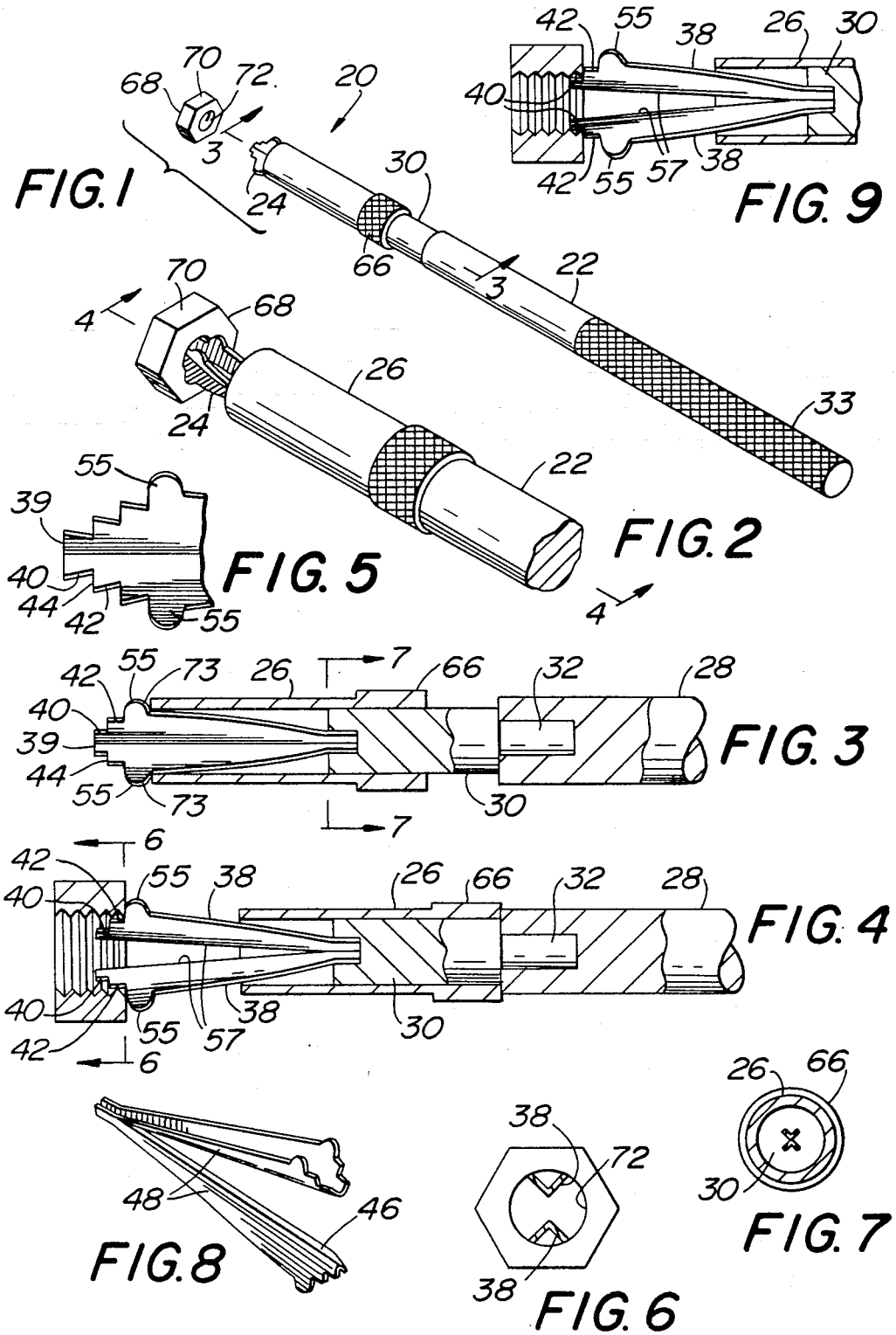
FIG. 1 is an exploded three dimensional view showing a nut starter with special blades constituting a first embodiment of the present invention, immediately prior to insertion in the opening of a nut.
FIG. 2 is an enlarged fragmentary three dimensional view illustrating the nut starter of FIG. 1 releasably secured within the central opening of a nut.
FIG. 3 is an enlarged sectional view taken along the lines 3—3 of FIG. 1.
FIG. 4 is an enlarged sectional view, similar to FIG. 3, showing the blades of the bit portion of the nut starter of the present invention in their open condition and engaged within the opening of a nut.
FIG. 5 is a view showing a modification of the blades which are shown to have a negative taper.
FIG. 6 is an enlarged sectional view taken along the lines 6—6 of FIG. 4.
FIG. 7 is an enlarged sectional view taken along the lines 7—7 of FIG. 3.
FIG. 8 is a three dimensional view showing the blades used in the preferred embodiment of the invention.
FIG. 9 is a fragmentary view, similar to the left hand portion of FIG. 4, but showing the inner flats of the blades engaged within the opening in a nut.

Referring now in greater detail to the various figures of the drawings wherein like similar reference characters refere to like parts, a nut starter with special blades is generally shown at 20 in FIG. 1. Device 20 basically comprises a shank 22, a bit portion 24 secured in said shank and a sleeve 26 slidably mounted over the shank and bit portions.

Shank 22 basically comprises (FIG. 3) an elongated rod 28 and insert 30 in the manner of U.S. Pat. No. 3,288,184. Rod 28 is provided with an axial bore 32 (FIG. 3) at one end thereof to which the insert 30 is secured. This securement can be made by a pressed fit or other means known in the art. In order to assist in this securement, splines as in U.S. Pat. No. 3,288,184 (not shown) are formed in the entire rear outer surface of the insert 30. Thus, these splines will be physically pressed into the metal or other material of rod 28. Much of the outer portion of the rod 28 (FIG. 1) is provided with knurling 33 for aiding in grasping and turning the shank 22 during the threading or starting of a nut onto a threaded members, such as a screw shank.

Bit portion 24 is secured in insert 30 by a stake fastening as will be discussed hereinafter. Bit portion 24 basically comprises a pair of resilient blades 38. As best seen in FIG. 4 the tip 39 of each blade is flattened. In the embodiment shown (FIG. 6), the angle between the two legs of each V is 90°. As further seen in FIG. 6 the two V's open in opposite directions from each other. Thus, in the embodiment shown, each leg of each blade is 90° out of phase with an adjacent leg. However, it is clear that the angles between the legs of each V can be varied accordingly. Also, the blades need not be bent as shown in FIG. 8, but instead can be single flat members possessing the necessary steps as will be discussed hereinafter.

In the preferred embodiment each blade 38 is preferably formed of a rectangular piece of resilent metal, such as spring steel, although in certain applications a wire or even a plastic material, such as nylon can be used. With a nut starter, spring steel is generall preferred to provide the necessary rigidity and strength to furnish adequate torque from the nut starter blades to the internal threaded surfaces of the opening in the nut.

The construction of the forward portions of the blades 38 can be best seen in FIG. 3 with a modified form being shown in FIG. 5. As best seen in FIG. 3 the forward portions of the blades 38 involve inner flat 40 and outer flat 42 connected by adjoining step 44 which extends generally perpendicular to the flats. The outer flat 42 connects with the ears 55 to complete the forward portions of the blades.

In the preferred embodiment the step or steps, such as step 44 are generally perpendicular to the axis of shank 22 in the configuration shown in FIG. 3 and FIG. 5. The flats 40 and 42 form an angle of 90° or perferably somewhat less with respect to the generally perpendicular steps 44 with the optimum angle range lying between 65° to 85° as generally illustrated in FIG. 5. As further shown in FIG. 5 additional flats and steps are provided as may be necessary to accommodate varying sizes of nut openings.

It will be appreciated that the precise number of additional steps to be provided will be as necessary to accommodate varying sizes of nut openings.

The rear portion of the blank of each blade in the preferred embodiment is provided with a hole (not shown) to assist in securement in the manner of U.S. Pat. No. 3,288,184.

The forward portion of the blades 38 is then formed of the V-shape as shown in FIG. 8 by bending it along a medial line 46. Additionally, upturned walls 48 are formed immediately behind the front portion by bending the blank upwardly. As further seen in FIGS. 7 and 8 the rear portions of the blades 38 abut. Thereafter, the two blades diverge about a central planar portion. The blades are then bent inwardly to converge with the base of each wall 48 and meet at a central planar portion. Also, the blades instead of being bent into V-shape may be flat or planar, as long as they have inner and outer flats as discussed hereinabove.

After the blade portions have been formed they are placed in back-to-back relationship as shown in FIG. 3, thereby forming bit portion 24. Thereafter, a pair of blades is secured in insert 30 in the manner as described in U.S. Pat. No. 3,288,184 which includes the provision of a slot and the insertion of the blades 38 into the slot with the holes aligned. The blades are then secured in place in the slot by a stake fastening which is formed by punching the insert immediately above and below the aforesaid holes. The punching operation crimps the material of insert 30 and forces it into the hole. Clearly, other fastening techniques, as known to those skilled in the art, may be used to secure the blades in place.

The nut starter of the present invention is completed by inserting bit portion 24 and its associated insert 30 into the sleeve 26. Thereafter, the insert 30 is forced into the bore 32 of rod 28 and held frictionally in place through the aid of splines as further described in U.S. Pat. No. 3,288,184. Thus, securement is made solely through a pressed fit and is maintained in place through the additional frictional force of the spline engaging the walls of the bore 32.

From a comparision of FIGS. 3 and 4 it can be seen that the sleeve 26 is slidably mounted and is freely movable along the shoulder of insert 30 and the blades 38. Also, sleeve 26 is tubular and includes an external collar 66 which has a knurled surface. In another embodiment of the invention the sleeve 26 may be advanced back and forth in a rotational or other movement. In the case of the rotational movement appropriate threads are provided.

The nut starter of the present invention can be used with many nuts of varying configuration. In the embodiment shown in FIG. 1 nut 68 has hexaganol flats 70 in a configuration well known to those skilled in the art.

In use, sleeve 26 is pushed or otherwise advanced forwardly from the blade open position of FIG. 4 to the closed position of FIG. 3 until the forward edge of sleeve 26 abuts the rear edge 73 of ears 55 as can be seen in FIG. 3. The movement of sleeve 26 in the preferred embodiment, is facilitated by grasping knurled collar 66.

In order to aid in the depression of the legs of blades 38 the axes of the blades 38 at the vertex of each V are cut to a flattened condition. With the blades 38 in the depressed condition of FIG. 3 they are inserted into the threaded opening 72 of a nut 68 with one or both of the flats 40 and 42 entering the threaded opening 72 of the nut 68. With a small opening in the nut only flats 40 enter the opening. With larger nut openings, both flats 40 and 42 enter the nut opening.

Thereafter, sleeve 26 is pulled rearwardly to the retracted position of FIG. 4, thereby permitting the blades 38 to diverge slightly as shown in FIG. 4. Thus, one of the flats 40 or 42 (outer flat 42 in FIG. 4) contacts a portion of the threaded opening of the nut 68. When this contact occurs, the divergency of the blades 38 is limited to the extent as permitted by the size of the opening 72. It can therefore be seen that as the blades 38 expand, they (either flats 40 or 42) will resiliently grasp the inner threaded walls of the nut 68, thereby securing the nut starter within the nut.

With the nut held resiliently in place as shown in Fig. 4, it is then a relatively simple matter to apply the nut to a threaded member, such as a screw in proper relationship. This is accomplished by merely grasping the knurled portion of the rod 28, using the nut starter to place the nut opening 72 in proper relationship to the threaded member and rotating the knurled portion of the nut starter in the correct direction.

Thus, the nut can be inserted upon the screw thread or other threaded member which is located at a remote or relatively inaccessable place, when using only one hand. Since the starting action may require some torque, it is preferred that at least the blades 38 be made of spring steel. However, in certain industries, such as the electronics industry, it may be necessary to make the entire tool, including the blade, from a plastic, such a nylon, because of the necessity to have electrical insulating properties.

After the nut has been started in the hole, the nut starter of the present invention is easily removed from the nut, if desired. It is conceivable that in some instances, the best approach would be to maintain continued rotation of the nut starter so that advancement of the nut onto the threaded member will effectively force the forward portion of the nut starter out of the nut opening. Alternatively, the nut starter may be positively removed by pushing sleeve 26 forwardly, thereby compressing blades 38 which then release their resilient grasp on the threaded opening of the nut. Alternatively, the nut starter may be removed by merely pulling outwardly from the nut. Since the nut is now threadedly secured in place and the blades are resiliently engaged, there is no fear of the nut becoming disengaged upon removal of the starter.

In some instances, after the nut starter of the present invention has been removed, a conventional tool such as a socket ratchet may be used to complete the tightening operation.

Other materials comprising the rod 28 should meet the standards of having a strength and hardness characteristics to permit the transmission of torque to the bit portion 24 without distorting the rod. In addition to the materials previously disclosed, wood, plastic and aluminum may also be used. Furthermore, where metal is used, the metal may be coated with a plastic such as nylon for insulating purposes.

Insert 30 may be made of any material which will securely hold bit portion 24 and can be secured in rod 28.

With respect to blades 38, any material which is sufficiently resilient to hold the nut in place may be used. A material which has given excellent result is Tempered 55–80 Carbon Spring Steel. This tempering treatment comprises subjecting spring steel to a temperature of 1400° F. to 1500° F. for 15 to 20 minutes. The steel is then drawn to the proper temper. At this temper the Rockwell hardness is approximately $40^C$ to $50^C$. Although, this particular steel is found to be particularly effective, any spring steel may be used.

The present invention is intended to be used with nuts of varying construction, irrespective whether such nuts now exist or will be developed in the future. The present invention is intended to be useful with the overwhelming majority of nut outer and internal opening sizes and configurations.

Without further elaboration, the foregoing will so fully illustrate my invention that other may, by apply current or future knowledge, readily adapt the same for use under various conditions of service.

I claim:

1. A nut starter with special blades, said nut starter comprising a shank portion and a bit portion formed on one end thereof, said bit portion comprising two divergent blades secured on said shank portion, said blades having outer edges extending from the tip of the blades, said outer edges possessing at least one flat extending generally parallel to the axis of said bit portion, said outer edges further including for each flat an adjoining generally slightly less than perpendicular step, each flat being adapted to be releasably secured within the opening of a nut, each of said flats having an edge which makes an angle with the adjoining step not exceeding 85°, a sleeve movably mounted over said shank portion and said bit portion, said blades including divergent surfaces within the area covered by said sleeve whereby movement of said sleeve in a forward direction will cause said blades to converge to allow any one of said flats to enter within the opening of the nut and wherein movement of said sleeve in a rearward direction will permit said blades diverge whereby one of said flats contacts a portion of the surface of said nut defining said nut opening.

2. The nut starter of claim 1, wherein each of said flats have an edge which makes an angle of from 65° to 85° with respect to an adjoining step.

3. The nut starter of claim 2, wherein said flats have edges that are essentially parallel to the longitudinal axis of said nut starter.

4. The nut starter of claim 1 wherein there are two steps in said outer edges.

5. The nut starter of claim 4 wherein there are three flats associated with said two steps.

6. The nut starter of claim 1 wherein said sleeve is slidably mounted over said shank portion.

* * * * *